United States Patent [19]

McLaughlin

[11] Patent Number: 4,523,418

[45] Date of Patent: Jun. 18, 1985

[54] MODULAR CONSTRUCTION SYSTEM

[76] Inventor: Jon R. McLaughlin, 1 Rutherford La., St. Louis, Mo. 63131

[21] Appl. No.: 523,096

[22] Filed: Aug. 15, 1983

[51] Int. Cl.[3] ..... E04B 1/348; A63H 33/08

[52] U.S. Cl. ..... 52/284; 52/582; 52/668; 403/285; 446/478

[58] Field of Search ..... 52/284, DIG. 10, 668, 52/648, 524, 582; 220/4 R, 4 F, 76; 229/48 R; 403/283, 285, 346, 347, 393; 446/108, 109, 114, 115, 488, 489, 478

[56] References Cited

U.S. PATENT DOCUMENTS

| | | | |
|---|---|---|---|
| 2,075,259 | 3/1937 | Battjes . | |
| 2,281,371 | 4/1942 | Mugler | 52/284 X |
| 2,454,307 | 11/1948 | Cooley . | |
| 2,832,100 | 4/1958 | Swallert | 52/284 |
| 3,066,436 | 12/1962 | Schuh | 446/115 |
| 3,120,078 | 2/1964 | Bessinger . | |
| 3,296,767 | 1/1967 | Lebowitz | 52/648 X |
| 3,341,908 | 9/1967 | Lock | 229/48 R X |
| 3,486,285 | 12/1969 | Bowling et al. | 52/284 |
| 3,654,717 | 4/1972 | Lane | 52/DIG. 10 |
| 3,846,218 | 11/1974 | Wootten | 229/48 R |
| 3,998,004 | 12/1976 | Ehrlich . | |
| 4,055,019 | 10/1977 | Harvey . | |
| 4,124,444 | 11/1978 | Jabsen | 52/668 |
| 4,212,130 | 7/1980 | Walker . | |
| 4,253,268 | 3/1981 | Mayr . | |

FOREIGN PATENT DOCUMENTS

| | | | |
|---|---|---|---|
| 2734044 | 2/1979 | Fed. Rep. of Germany | 52/668 |

*Primary Examiner*—Donald G. Kelly
*Assistant Examiner*—Richard E. Chilcot, Jr.
*Attorney, Agent, or Firm*—F. Travers Burgess

[57] ABSTRACT

A construction system comprises modules of polygonal shape including elongated rectangles, squares, triangles and trapezoids of stiff sheet material formed with integral interlocking tabs along their margins to permit them to be easily and firmly secured to each other to form three dimension structures. Some of the modules also incorporate interlocking slots for securement to each other. This system is especially adapted to the construction by children of an infinite variety of large structures such as playhouses and the like of sufficient size to permit children to play in them.

19 Claims, 22 Drawing Figures 17
19
21
23
25
27
29
31
33
35
37
38
41
45
49
55
57
58
59
61
63
65
66
69
71
73
75
77
79
81

FIG. 18
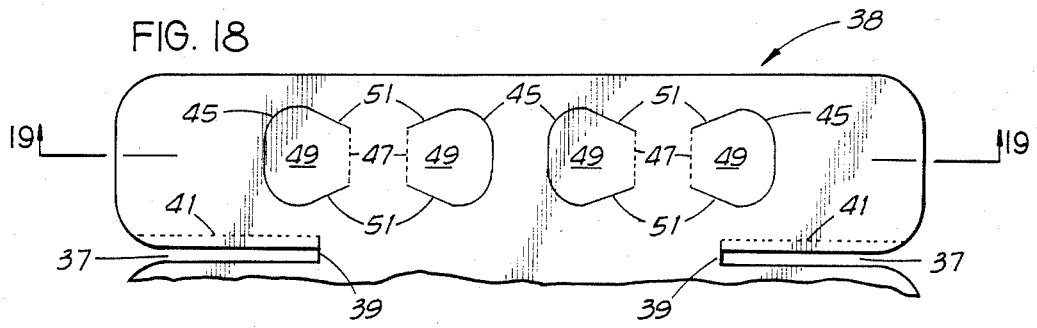
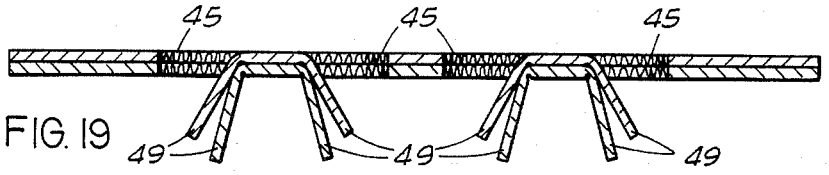
FIG. 19
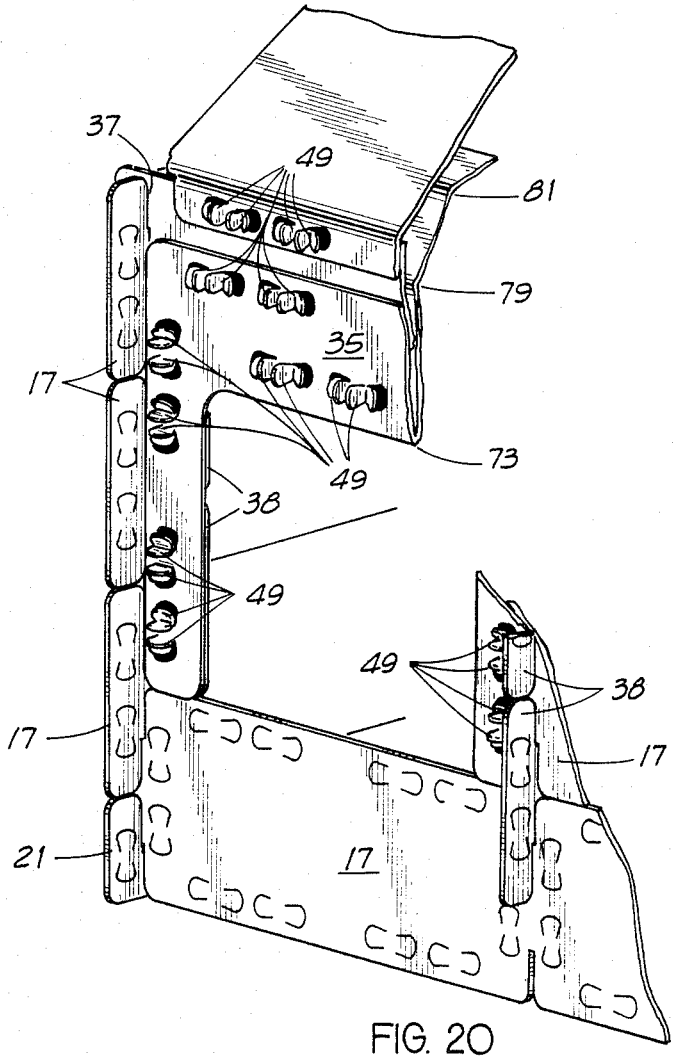
FIG. 20

MODULAR CONSTRUCTION SYSTEM

BACKGROUND OF THE INVENTION

1. Field of the Invention

The invention relates to modular construction systems and more particularly to such systems in which the modules are polygonal elements of stiff sheet material formed to interlock with each other in a unique and novel manner to form three dimensional structures.

2. The Prior Art

The prior art includes a number of construction systems utilizing card-like modules or elements of geometric or polygonal shape as exemplified by Harold A. Battjes U.S. Pat. No. 2,075,259 in which rectangular cards are fastened to each other by rectangular ears projecting from their edges into slits in the other cards; B. Cooley U.S. Pat. No. 2,454,307 in which generally oval projections on two adjacent edges of square cards fit into slots elongated along the other edges of the cards and having straight outer edges and arcuate inner edges; N. E. Bessinger U.S. Pat. No. 3,120,078 discloses polygonal panels with inwardly directed pegs projecting from the plane of each panel adjacent each side thereof, with elastic bands connecting the pegs to join the panels to each other; Ehrlich U.S. Pat. No. 3,998,004 discloses triangular panels with magnetic flaps for securing them to each other; E. H. Harvey U.S. Pat. No. 4,055,019 dicloses square and triangular panels with projections from their sides forming hinge-like connections; J. F. Walker U.S. Pat. No. 4,212,130 discloses a modular playhouse in which the modules are secured to each other by separate bendable strips with their ends inserted into slits adjacent the sides of the respective modules; and A. A. Mayr U.S. Pat. No. 4,253,268 discloses square, triangular and rectangular panels with cooperating ball and scoket connections between them.

SUMMARY OF THE INVENTION

The invention provides a modular construction system in which the modules or units are polygons of relatively stiff sheet material all formed with novel fastening means arranged to secure two or more modules to each other, permitting easy assembly and disassembly of the structures, all fasteners being identical (i.e., not requiring separate mating male and female elements) and being shaped to provide wedging action for firm securement, but formed with curved heads so as to eliminate sharp points, reduce stress flow and conform to finger shapes to facilitate pinch action, being swingable in both directions from the plane of the module and operable even if the male part or tab cooperating fastener is missing and operable from either side of the module.

The invention also provides elongated rectangular modules with transverse slots adjacent their ends and intermediate their ends capable of being fastened together with their planes at any angles from slightly more than 0° to almost 180°, as well as right angles, and to be assembled and disassembled rapidly and effortlessly even by small children.

The system is modular, with flap-edged modules wholly compatible with modules without flaps, can form an infinite variety of structures from simple to complex, all edges being compatible with each other and the last module being in a structure compatible with all the others, is formed to prevent bunching at multiple intersections of modules by having all flap edges recessed from the ends of the flaps, can be stored in small space and packed flat for ease in shipping or mailing.

By rounding all corners, likelihood of damage to the modules is minimized and injury to children from sharp corners is virtually eliminated.

The design of the fasteners permit the substitution of extra fasteners if the fasteners are damaged and the addition of extra fasteners where extra strength is required.

The modules can be made of a variety of materials including, but not limited to, corrugated cardboard, polyethylene/polypropylene copolymer/plastic for outdoor use and may be transparent or translucent for windows or roof panels.

BRIEF DESCRIPTION OF THE DRAWINGS

FIG. 18 is an enlarged fragmentary view of the extra fasteners of FIG. 12.

FIG. 19 is a sectional view along line 19—19 of FIG. 18 showing the tabs or two elements in assembled relation.

FIG. 20 is an enlarged portion of an assembled structure showing details of the assembly.

DETAILED DESCRIPTION OF THE INVENTION

Figure 1:
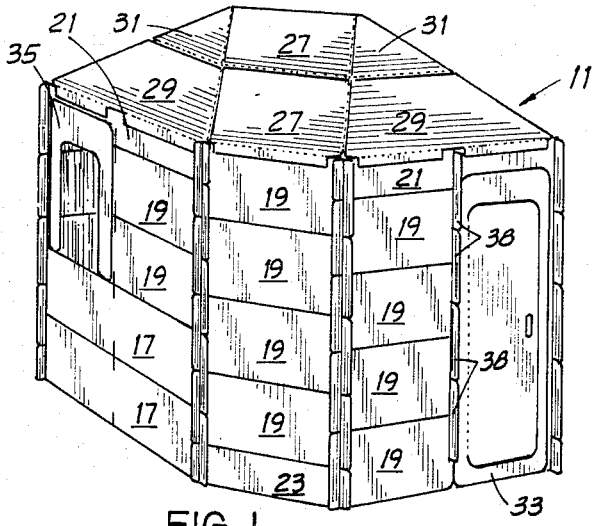
FIG. 1 is an isometric view of a hexagonal playhouse constructed with modules embodying the invention.
Figure 2:
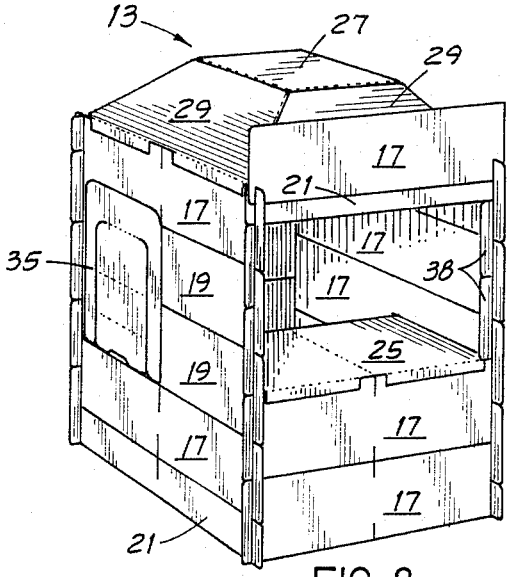
FIG. 2 is an isometric view of a miniature store or lemonade stand constructed with modules embodying the invention.
Figure 2A:
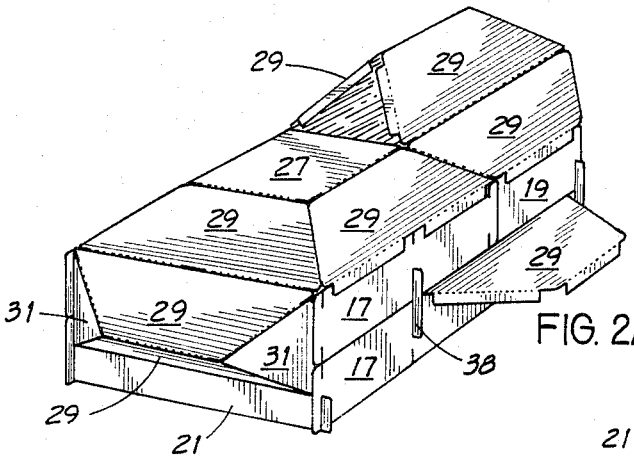
FIG. 2A is an isometric view of a simulated space ship constructed with modules embodying the invention.
Figure 3:
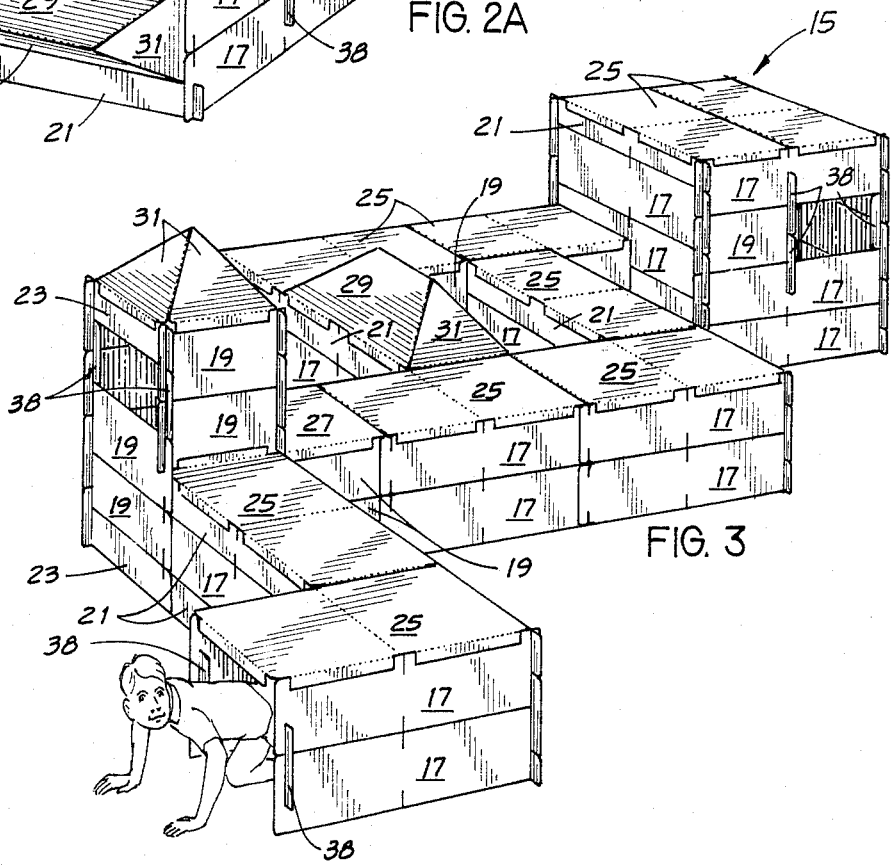
FIG. 3 is an isometric view of fanciful structure incorporating a tunnel, a tower and other elements constructed with modules embodying the invention.
Figures 4, 5, 6, 7, 8, 9, 10, 11, 12, 13, 14:
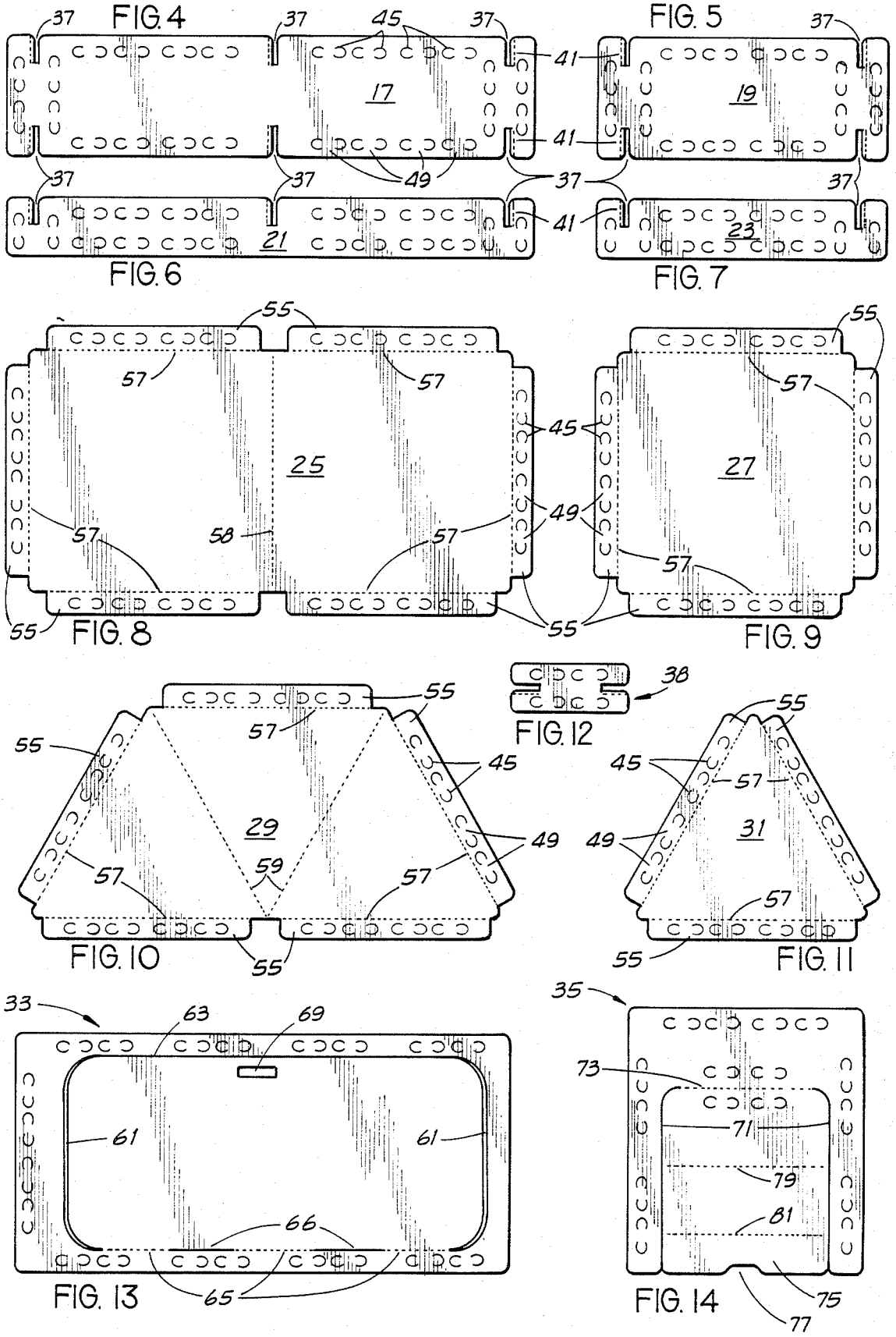
FIG. 4 is an elevational view of a long elongated rectangular double-slotted edge type of module.
FIG. 5 is an elevational view of a short elongated rectangular double-slotted edge type of module.
FIGS. 6 and 7 are elevational views respectively of a long and short elongated rectangular single-slotted edge type of module.
FIGS. 8 and 9 are elevational views respectively of an elongated rectangular (or double square) and square modules with bendable fastener flaps along their peripheries.
FIGS. 10 and 11 are elevational views respectively of a trapezoidal and a triangular module with bendable fastener flaps along their peripheries.
FIG. 12 illustrates separate auxiliary fastener.
FIG. 13 is a module formed with a full size door-like opening and closure therefor.
FIG. 14 is a module formed with a window or creep door opening and closure therefor.

The structures 11, 13 and 15 of FIGS. 1–3 respectively incorporate slotted rectangular modules 17, 19, 21 and 23 of FIGS. 4–7 respectively, flap-edged rectangular and square modules 25 and 27 of FIGS. 8 and 9 respectively, trapezoidal and triangular flap-edged modules 29 and 31 of FIGS. 10 and 11 respectively, door and window modules 33 and 35 of FIGS. 13 and 14 respectively and extra fasteners 38 of FIG. 12, and the modules are joined in the manners illustrated in FIGS. 15–20.

As will be noted from FIGS. 1–3, the structures therein are all formed from the basic modules 17, 19, 21, 23, 25, 27, 29, 31, 33, 35 and extra fasteners 38.

Figure 15:
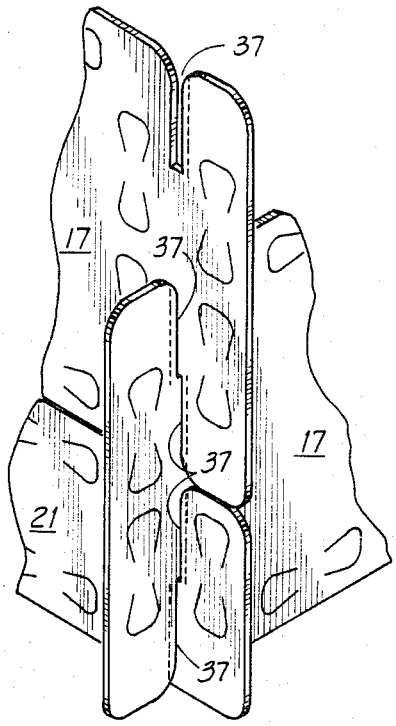
FIGS. 15–17 are fragmentary isometric views showing connections between the slotted modules of FIGS. 4–7.

The wide slotted rectangular modules 17 and 19 are both formed with slots 37 in aligned pairs extending inwardly from both long edges of the modules and parallel to and in closely spaced relation to the short edges or ends of the module. Slots 37 are substantially one-fourth as long as the width of the module so that when two of the modules in coplanar relation are joined to a third module at right angles with respect to the two coplanar modules, by inserting the aligned slots of the third module into the aligned opposing slots of the coplanar modules, as best seen in FIG. 15, the adjacent long edges of the two coplanar modules will closely abut each other to form a continuous planar wall structure.

To permit flexibility in wall lengths, modules 17 are twice as long as modules 19 and to permit the construction of intersecting walls intermediate the ends of modules 17, they are formed with an additional pair of aligned slots 37 intermediate the end pairs.

Figure 16:
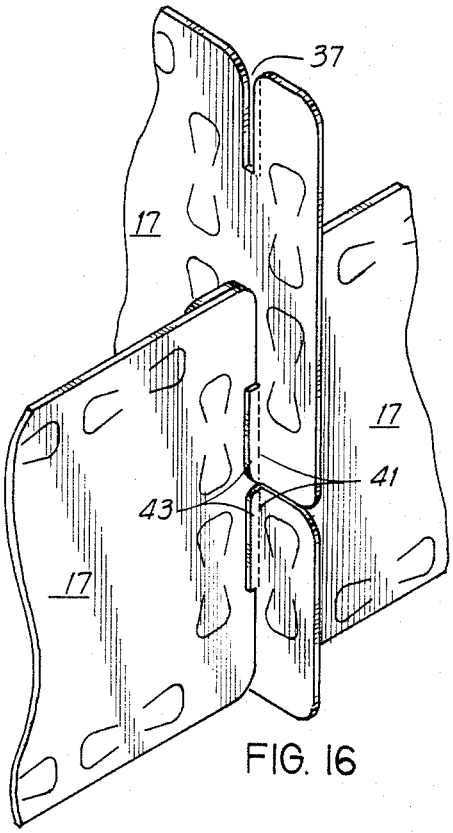
Figure 17:
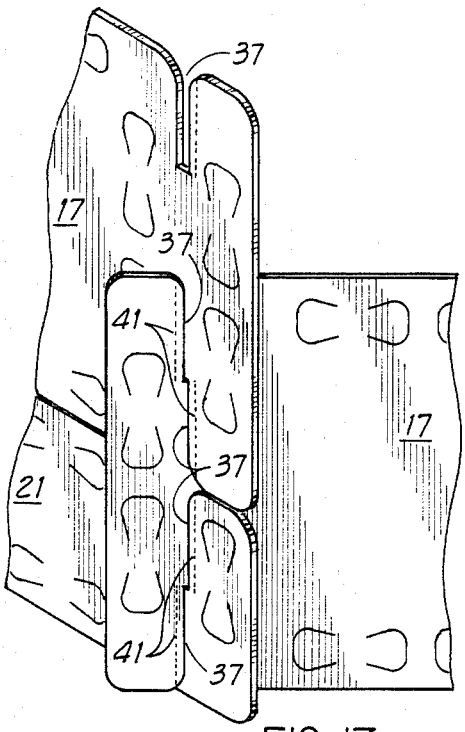

To accommodate a double thickness of modules 17, as seen in FIG. 16, and to facilitate connection of modules 17 to each other at other than right angles, as best seen in FIG. 17, the inner terminal cuts of slots 37 are wider than the slots and are connected by scoring 41 parallel to the slots to form narrow flaps 43 deflectable to widen the respective slot.

To fill in at the top and bottom walls and the like constructed with modules 17 and 19 and slotted rectangular modules, for other situations where narrower modules are required, 21 and 23 equal in length respectively to modules 17 and 19, but only half as wide and having slots 37 in one edge only are provided and may be used in the manners shown in FIGS. 1, 2, 3, 15 and 17.

For securing modules 17, 19, 21 and 23 to other types of modules, such as 25, 27, 29, 31, 33 and 35, not formed with slots 37, the marginal regions of modules 17, 19, 21 and 23 are formed with pairs of facing generally C-shaped cuts 45, as best seen in FIG. 18, the ends of which are connected by scoring as at 47 to permit the tabs 49 so formed to be pushed out of planar relationship with the respective module, so that when the margins of two modules are superimposed one on the other as shown in FIGS. 19 and 20 with the tabs 49 in alignment, the aligned tabs may be pushed to the position best seen in FIG. 19, the cuts 51 forming the sides of the tabs being oppositely inclined outwardly from their intersections with scoring 47 to firmly secure the adjacent modules to each other by a wedging action, and the connecting portion of the cuts being arcuate to facilitate use of a finger to punch the tabs into locking or unlocking positions.

Module 25 of FIG. 8 is of generally rectangular shape, substantially twice as long as its width and is formed with a pair of projecting marginal flaps 55 along its long edges and a single identical flap 55 along each of its short edges, the flaps being divided from the body of the panel by scoring and each flap 55 being cut at 45 to form pairs of tabs 49 spaced apart the same as tabs 49 of modules 17, 19, 21 and 23. By bending the flaps 55 to provide desired angularity with respect to another adjacent module, and aligning the tabs with those of the adjacent module, module 25 can be secured to an adjacent module by pushing the adjacent tabs 49 into locking relation with each other. To permit bending of modules 25 along their transverse center lines, if desired, they are scored at 58.

Square module 27 of FIG. 9 is similar to rectangular module 25 except for shape and its four flaps 55 are identical to those of module 25.

It will be noted that the flaps 55 are of slightly less length than the sides of the respective modules so that the rounded corners of the modules project from the ends of the respective flaps. This feature prevents bunching at multiple intersections.

It should also be noted that all corners of the modules are rounded, thus eliminating the danger that users of the modules, particularly small children, might be injured by sharp corners.

The trapezoidal module 29 of FIG. 10 has a single flap 55 along each of its short edges and a pair of identical flaps along its long edge and is shaped and scored internally at 59 to define three equilateral triangles, each the same size as equilateral triangle module 31 of FIG. 11.

By reference to FIG. 1 it will be seen how trapezoidal modules 29, square modules 27 and triangular modules 31 can be joined to form a hip roof, the flaps 55 of each being bent downwardly into abutting relation with each other for union by means of tabs 49.

The pyramidal roof on the tower of FIG. 3 can be formed by bending trapezoidal module 29 along scored lines 59 and joining its two base flaps 55 to two of the flaps 55 of triangular module 31.

Door module 33 of FIG. 13 is slightly less width than the other single modules and is formed with a cut having straight ends 61 parallel to its short edges and a straight side 63 parallel to its long edges, and is alternately scored and cut at 65 and 66 parallel to its long edges, the intersection between the ends 61 and side 63 of the cut being arcuate, and the intersection between ends 61 and scored-cut line 65–66 being arcuate cuts, to form a door 67 swingable about scored line 65. A narrow elongated slot 69 in the door 67 adjacent and parallel to side 63 of the door forms a handhold.

A window or creep door module 35 illustrated in FIG. 14 is shorter than door module 33 and is formed with straight side cuts 71 extending upwardly from the lower edge of the module parallel to and terminating at the same level in inwardly curved ends connected by a horizontal scored line 73, the cut-out portion 75 being swingable about scored line 73 to form a closable window opening. The bottom edge of the cut-out portion 75 is formed with a shallow elongated notch 77 to provide a handhold for opening and closing the window and the cut-out portion may have some intermediate horizontal scores 79 and 81 to permit the cut-out closure portion to be bent as shown in FIG. 20.

Although the door and window modules 33 and 35 do not have flaps, they are formed with locking tabs along their top and side margins and window modules 35 are also formed with rows of locking tabs 49 parallel to and on opposite sides of hinge formed scored line 73 which may be interlocked to hold the window closure 75 in raised or open position. The door and window modules are also formed with locking tabs 49 along their top and side margins for securement directly to modules 17, 19, 21, 23, 25, 27, 29 and/or 31, or to extra fasteners 38, and by the slots in extra fasteners 38 to adjoining slotted modules 17, 19, 21 and/or 23 as shown in FIG. 20.

As seen in FIGS. 12 and 18, extra fasteners 38 are of rectangular shape with their long dimension equal to the width of the large slotted rectangular modules 17 and 19 and their short dimension the same as the end portions of modules 17 and 19 separated by slots 37.

Figure 21:
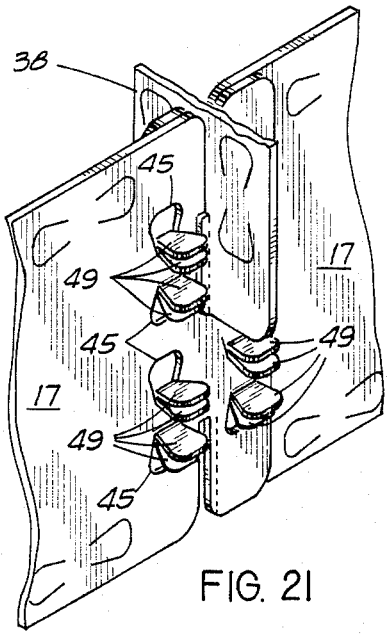
FIG. 21 illustrates the manner in which a pair of modules can be joined end-to-end by lapping their ends.

In FIG. 21 a pair of modules 17 are shown in end-to-end lapped relation with tabs 49 interlocked to retain them in their lapped relation. This arrangement provides longer aligned wall elements than would be provided by either the short modules 19 or the long modules 17.

From the foregoing it will be evident that all the modules are connectable to other because of the identical positions of the tabs 49 and the fact that the bodies of all the modules have some common peripheral dimensions or multiples of the same common peripheral dimensions.

The manner in which the modules can be joined to form an infinite variety of structures such as those of FIGS. 1–3 will be evident from the drawings and the foregoing description.

The details of the invention may be varied substantially without departing from the spirit of the invention and the exclusive use of those modifications as come within the scope of the appended claims as contemplated.

I claim:

1. A construction system comprising modules formed of substantially stiff sheet material, each module being formed adjacent its edges with pairs of oppositely facing tabs, each pair of tabs being defined by pairs of substantially C-shaped cuts in the material of the module with the respective C-shaped cuts of each pair facing each other and spaced apart a short distance, the material being scored along parallel straight lines connecting the terminals of the respective cuts to permit the resultant tabs to be bent out of the plane of the module, corresponding tabs on all modules being similarly spaced and oriented whereby the scored lines and cuts defining the respective tabs on lapped margins of a pair of modules are in registry with each other, said modules being securable to each other by lapping margins of a pair of said modules to place pairs of said tabs of the respective modules in registry with each other and bending both tabs of each pair about the scored line in the same direction away from the respective modular sheets, whereby to lock the respective modules to each other.

2. A modular construction system according to claim 1, wherein the terminal portions of the C-shaped cuts of said tabs are substantially straight lines diverging from the terminals of said cuts and the ends of said tabs remote from the scored connections of said tabs with the body of the modules are arcuate.

3. A modular construction system according to claim 1, wherein some of said modules are of elongated rectangular shape and have straight slots extending inwardly from their long sides and parallel to their short ends, at least some of said slots being adjacent the marginal end portions of the respective modules.

4. A modular construction system according to claim 3, wherein said slots are half as deep as the width of the respective modules and extend inwardly from one side only of the module.

5. A modular construction system according to claim 4, wherein the module is twice the width of that of claim 4 and the slots are a quarter as deep as the width of the respective module in and extend inwardly from both sides of the module aligned pairs.

6. A modular construction system according to claim 3, including additional slots extending inwardly from a side of the respective modules and parallel to the ends thereof intermediate the first-mentioned slots adjacent the marginal end portions of the module.

7. A modular construction system according to claim 1, wherein said modules are of polygonal shape.

8. A Modular construction system according to claim 7, wherein at least some of said modules are of rectangular shape.

9. A modular construction system according to claim 8, wherein at least some of said modules are square.

10. A modular construction system according to claim 7, wherein at least some of said modules are of triangular shape.

11. A modular construction system according to claim 10, wherein at least some of said modules are of isosceles triangular shape.

12. A modular construction system according to claim 11, wherein at least some of said modules are of equilateral triangular shape.

13. A modular construction system according to claim 7, wherein at least some of said modules are of trapezoidal shape.

14. A modular construction system according to claim 13, wherein at least some of said modules are of isosceles trapezoidal shape.

15. A modular construction system according to claim 13, wherein at least some of said modules have base angles of 60 degrees and the bases are twice the length of the sloping sides.

16. A modular construction system according to claim 1, wherein at least some of said modules are formed with cuts parallel and adjacent to their opposite margins and are scored at right angles to said cuts at one end of said cuts, whereby said cuts and scoring from an aperture with a flap closure.

17. A modular construction system according to claim 16, wherein in at least some of said modules said cuts terminate within the module and are connected at their ends remote from the scoring by a third cut parallel to the scoring.

18. A modular construction system according to claim 16, wherein in at least some of said modules the ends of said cuts remote from the scoring intersect the edge of the module remote from and parallel to the scoring.

19. A modular construction system comprising modules of elongated rectangular shape having straight slots extending inwardly from their long sides and parallel to their short end, at least some of said slots being adjacent the marginal end portions of the respective modules, said modules being scored parallel to said slots and in closely spaced relation thereto and cuts transverse of the respective slots defining the inner ends thereof being extended to intersect the parallel scoring.

* * * * *